US006540294B2

(12) United States Patent
Moffa et al.

(10) Patent No.: US 6,540,294 B2
(45) Date of Patent: Apr. 1, 2003

(54) STOWABLE SWING AWAY FLIP SEAT

(75) Inventors: Michael D. Moffa, Glenview, IL (US); Karim Youssef Mikhail, Chicago, IL (US)

(73) Assignee: Freedman Seating Company, Chicago, IL (US)

( * ) Notice: Subject to any disclaimer, the term of this patent is extended or adjusted under 35 U.S.C. 154(b) by 0 days.

(21) Appl. No.: 09/938,133

(22) Filed: Aug. 23, 2001

(65) Prior Publication Data

US 2003/0038519 A1 Feb. 27, 2003

(51) Int. Cl.[7] ..... A47C 1/02
(52) U.S. Cl. ..... 297/334
(58) Field of Search ..... 297/14, 316, 340, 297/331–335, 217.7

(56) References Cited

U.S. PATENT DOCUMENTS 2,177,263 A * 10/1939 Noe
2,257,211 A * 9/1941 Willoughby
3,762,764 A * 10/1973 McJunkin
4,460,215 A * 7/1984 Chamberlain et al.
5,489,141 A * 2/1996 Strausbaugh et al.
5,492,389 A * 2/1996 McClintock et al.
6,089,651 A * 7/2000 Carmen

FOREIGN PATENT DOCUMENTS

DE 4134053 * 4/1993

* cited by examiner

*Primary Examiner*—Milton Nelson, Jr.
(74) *Attorney, Agent, or Firm*—Alter and Weiss

(57) ABSTRACT

A seat that may be transported from a deployed position, where it is adjacent to the side of the support member, to a stowed position above the support member. The deployed position provides seating for an occupant. The stowed position provides a space for storing an item in the space formerly occupied by the deployed seat. The device uses a linkage system that supports the stowable swing away flip seat and is able to transport the stowable swing away flip seat, upon the exertion of a lifting force, along a predetermined path from a deployed to a stowed position above the support member.

16 Claims, 8 Drawing Sheets

STOWABLE SWING AWAY FLIP SEAT

BACKGROUND OF INVENTION

The adoption of the Americans with Disabilities Act has caused the transit industry to equip current bus designs with expensive and difficult to maintain wheelchair lifts. These lifts enable wheel chairs to have access to a bus, but require the vehicle driver to leave his seat and operate the lift, thereby slowing down bus service. The industry response to these initial efforts has been to design the bus so that a lift is not necessary. This is being accomplished by lowering the floor of the bus to the level of the street curb, whereby a wheel chair will be able to roll directly from the sidewalk onto the bus without the use of a mechanical lift. This lowering permits wheelchair access to the vehicle without the impediment of the traditional set of stairs.

The lowered floor bus, while easy to access, has the consequence of making the wheel wells protrude further into the interior of the bus. Consequently, the aisle space will be quite narrow between the wheel wells. When the aisle space is narrow, it cannot be used as effectively for holding passengers or cargo as other parts of the bus. However, two flip seats may be placed on each side of the aisle, with their backs proximate to opposing wheel wells and their fronts facing the aisle. Each flip seat has a back support portion and a flip seating portion that are hingedly associated with one another. The flip seating portion has a substantially horizontal position, where it is substantially perpendicular to the back support portion. Additionally the flip seating portion has a substantially vertical position, where it is proximate and substantially parallel with the back support portion. The flip seating portion may be limitedly rotated about the hingedly associated end, from its substantially horizontal position to the substantially vertical position. A wheelchair or other object may occupy the space formerly occupied by any one flip seating portion in the substantially horizontal position. While this provides more room, the flip seat will still occupy some space between the aisle and the wheel well. Therefore, simply rotating the seating portion of each flip seat will not provide enough space to position wheelchairs in these spaces without the wheelchairs also extending into part of the aisle. The solution is to make a swing away flip seat that is completely removable from the space between a wheel well and an aisle by being stored in the space above the wheel well.

One method of operation which would permit a swing away flip seat to be removed from the space between an aisle and a wheel well by being stored in the space above the wheel well, is pivoting it about an axis which runs substantially coextensive and parallel with the top of the back support portion and swinging it through an arc. Although this stores the stowable swing away flip seat out of the way it is very awkward, as the heavy part must be lifted a large distance above the floor. Additionally, this method causes the stowable swing away flip seat to swing further out into the aisle while it travels through the arc. Consequently, losing control of the stowable swing away flip seat while lifting could result in personal injury to an operator or a bystander. A second method of operation would entail pivoting the swing away flip seat about an axis that is substantially coextensive and parallel with the bottom of the back support portion of the stowable swing away flip seat. While this makes the load height lower it does not get the seat entirely out of the aisle area when stowed. Because the stowable swing away flip seat will extend into the aisle walkway, the use of the aisle by riders will be impeded.

The instant invention also relates to a method which permits a swing away flip seat to be removed from the space between an aisle and a wheel well by being rotated and stowed in the space above a wheel well or similar obstruction. The stowable swing away flip seat has a flip seating portion that can be limitedly rotated from a substantially horizontal position to a substantially vertical position. The stowable swing away flip seat can be transported from a deployed position to a stowed position above a wheel well or similar obstruction. Additionally, the stowable swing away flip seat is completely removable from the space between the wheel well and the aisle walkway. During the stowage operation the stowable swing away flip seat can be transported from a deployed position to a stowed position, all the while without extending further in the forward aisle walkway direction than while deployed with the flip seating portion in the substantially horizontal position. Additionally, during the stowage operation consistent weight distribution is maintained and the stowage operator is spared from performing awkward maneuvers. The instant invention will allow efficient and flexible utilization of the space adjacent to a wheel well or similar obstruction in low floor buses and will permit the transit industry to more effectively comply with the Americans with Disabilities Act.

SUMMARY AND OBJECTS OF THE INVENTION

Accordingly, it is the object of the present invention to provide a stowable swing away flip seat for mounting to a support member, such as a wheel well, that can be deployed adjacent to the support member and then stowed above the support member. The stowable swing away flip seat is stowed to provide space for a wheelchair, or other article, in the space formerly occupied by the deployed seat. The invention comprises a seat and a linkage system.

The linkage system comprises multiple bars, which further comprise multiple arms, preferably made from steel, that associate the stowable swing away flip seat with a support member. The linkage system supports the stowable swing away flip seat while deployed and stowed. Additionally, when a lifting force is applied to the stowable swing away flip seat, the linkage system, upon the exertion of a lifting force, generates a path that transports the stowable swing away flip seat from a deployed position to a stowed position above a support member. The arms may of the linkage system may be tailored so that the generated path confines the route traveled by the stowable swing away flip seat during the stowage operation so that it does not protrude further in the forward horizontal plane, relative to the support member, then it does while in its original deployed position. The preferred embodiment utilizes a four bar linkage system having two upper bars and two lower bars.

In some embodiments, the linkage system includes a biasing means to ensure a consistent distribution of weight during the stowage operation. The biasing means also allows the stowage operation to occur without invoking awkward movements from the stowage operator. Furthermore, the biasing means may comprise one or more pressurized cylinders.

The stowable swing away flip seat comprises of a seating portion, a back support portion, and a means for hingedly associating the two. The seating portion and back support portion are both preferably made from steel. The seating portion and back support portion collectively provide seating for an occupant while in the deployed position. The preferred embodiment has a means for hingedly associating the seating portion with the back support portion, however it is conceivable that the two could be fixedly attached. In the preferred embodiment, a seat plate portion, preferably made from steel, acts as a means for hingedly associating the seating portion with the back support portion. The seat plate portion may comprise a series of individual plates collectively fixedly to form the seat plate portion or a solid one-piece seat plate portion. The means of fixedly attaching the individual plates may comprise welding, or using nuts and bolts, or the like. In some embodiments, the seating portion is limited to rotating from a substantially horizontal position to a substantially vertical position, relative to the back support portion in a substantially vertical position.

The preferred embodiment utilizes the linkage system and support legs as a means of supporting the stowable swing away flip seat while deployed. The support legs act to channel the downward force of the stowable swing away flip seat to a support structure, such as a floor. The support legs extend from the stowable swing away flip seat to a floor, and thereby transfer the downward force of the stowable swing away flip seat to the floor. In the preferred embodiment the support legs are hingedly associated, however, conceivably they may be fixedly associated.

In addition to the linkage system the preferred embodiment utilizes a deflector plate, preferably made from steel, to limit the rotation of the stowable swing away flip seat upon the completion of the stowage operation. In such an embodiment, the deflecting plate is associated with the seat and limits rotation upon contacting a fixed structure, such as a wall.

For security, the preferred embodiment utilizes a positive locking means to lock the stowable swing away flip seat in a stowed position.

BRIEF DESCRIPTION OF THE DRAWINGS

In order to satisfy the objects of the invention discussed herein, a stowable swing away flip seat for mounting to a wheel well of a vehicle is provided as illustrated by the accompanying drawings wherein.

DESCRIPTION OF THE PREFERRED EMBODIMENT

Figure 1:
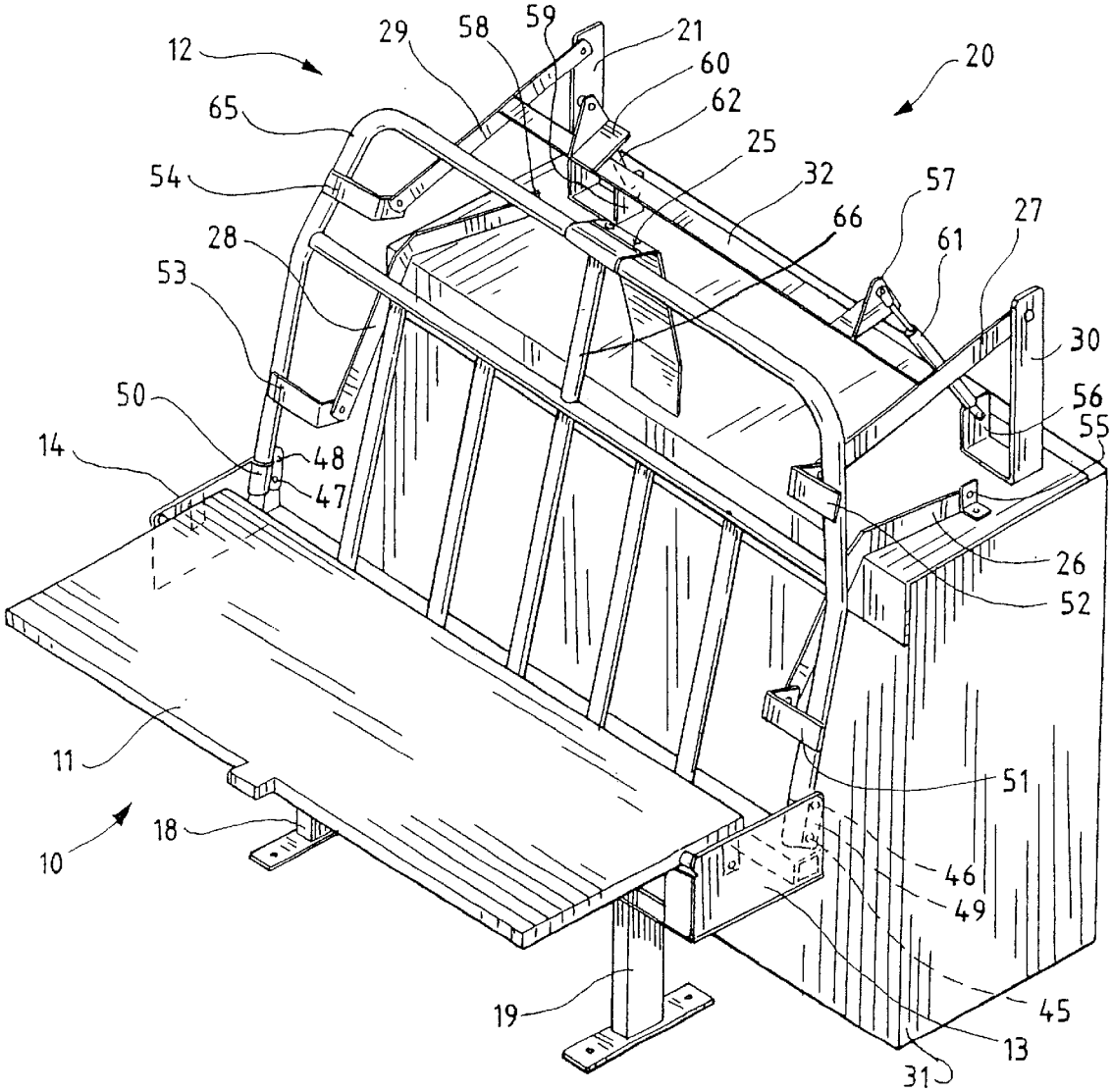
FIG. 1 is a pictorial view of the stowable swing away flip seat illustrating the flip seating portion in a substantially horizontal position and the stowable swing away flip seat in a deployed position.
Figure 2:
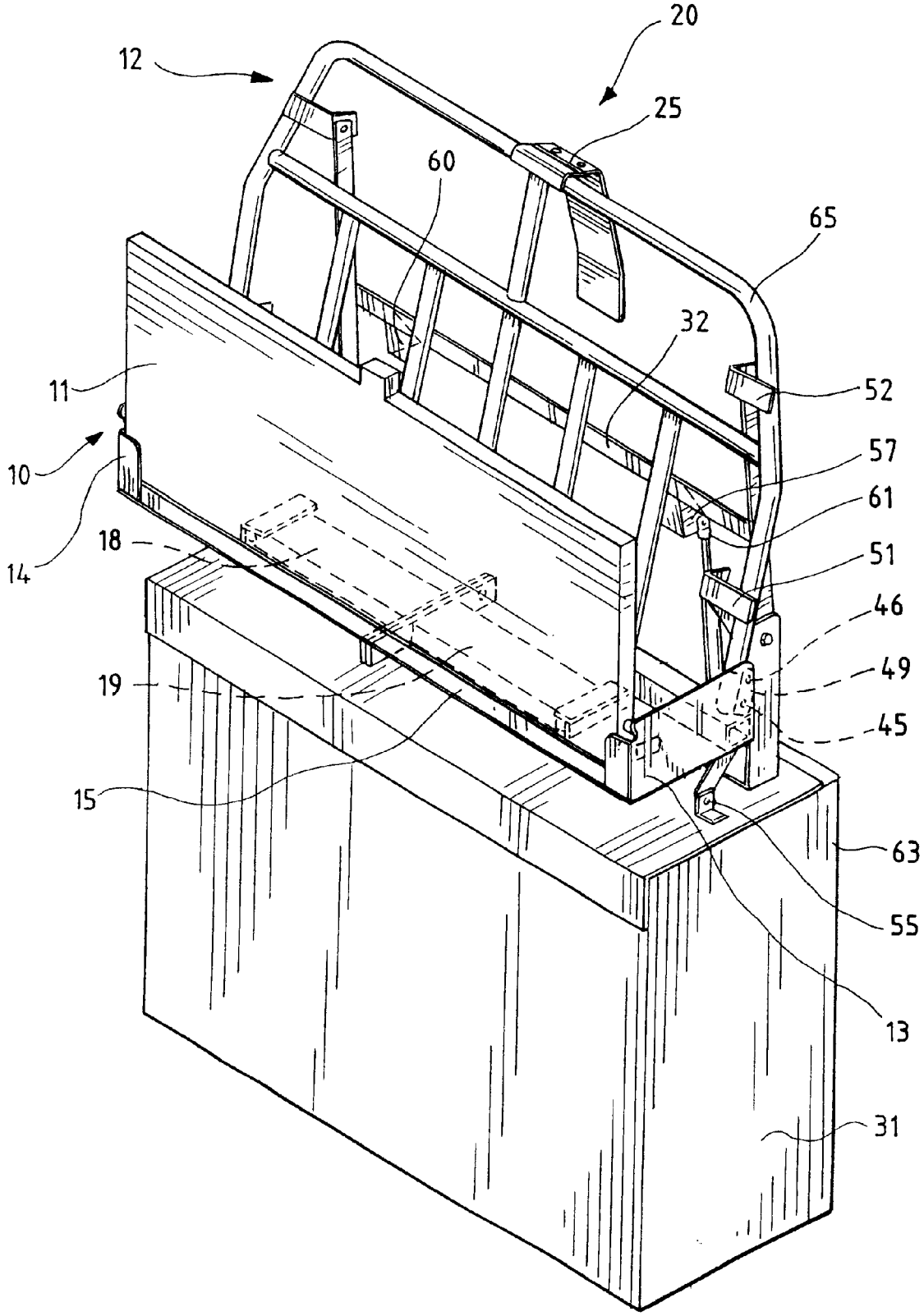
FIG. 2 is a pictorial view of the stowable swing away flip seat illustrating the flip seating portion in a substantially vertical position and the stowable swing away flip seat in a stowed position.
Figure 3:
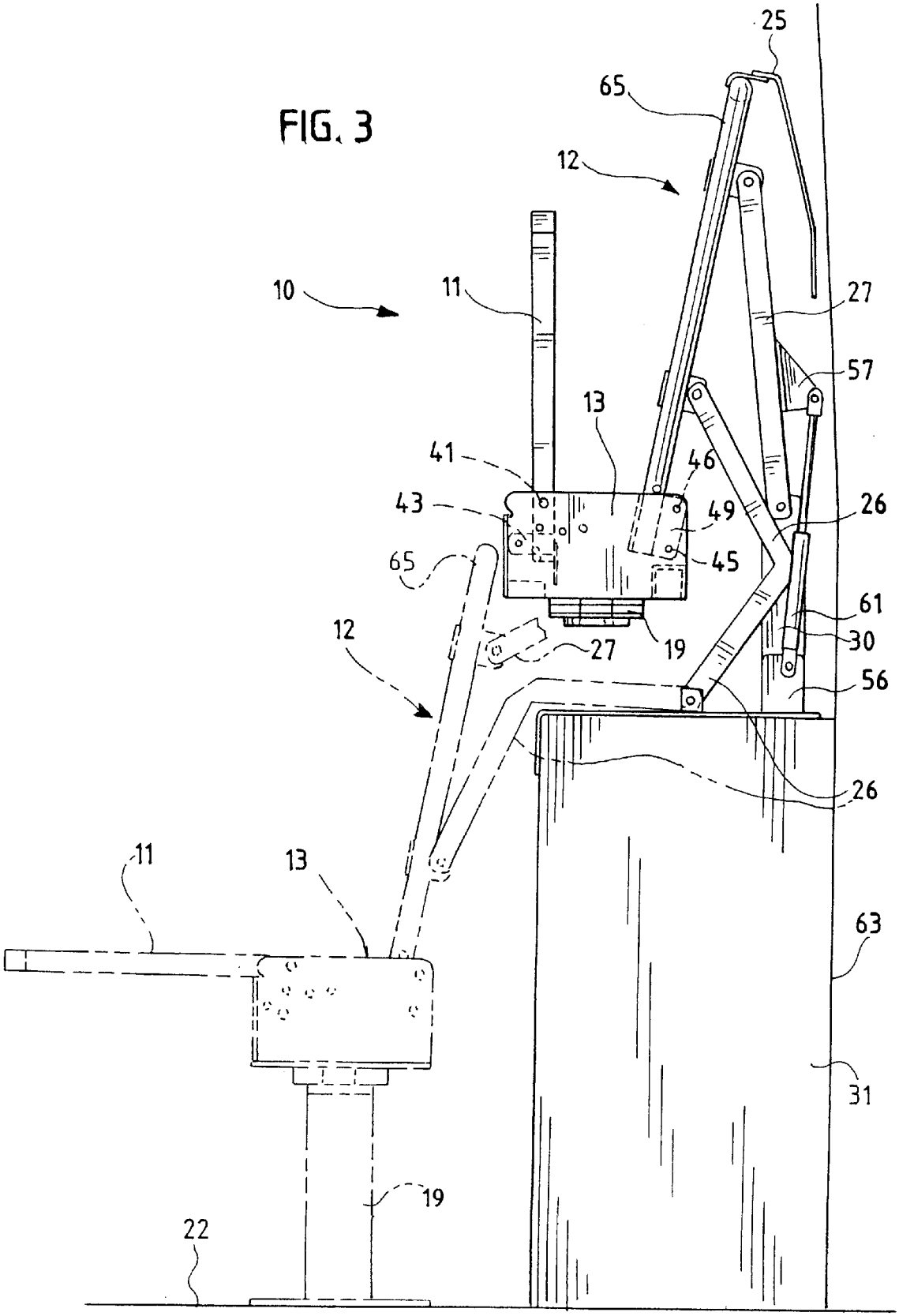
FIG. 3 is a side elevational view illustrating the flip seating portion in both a substantially vertical position and a substantially horizontal position and the stowable swing away flip seat in both its stowed and deployed position.
Figure 4:
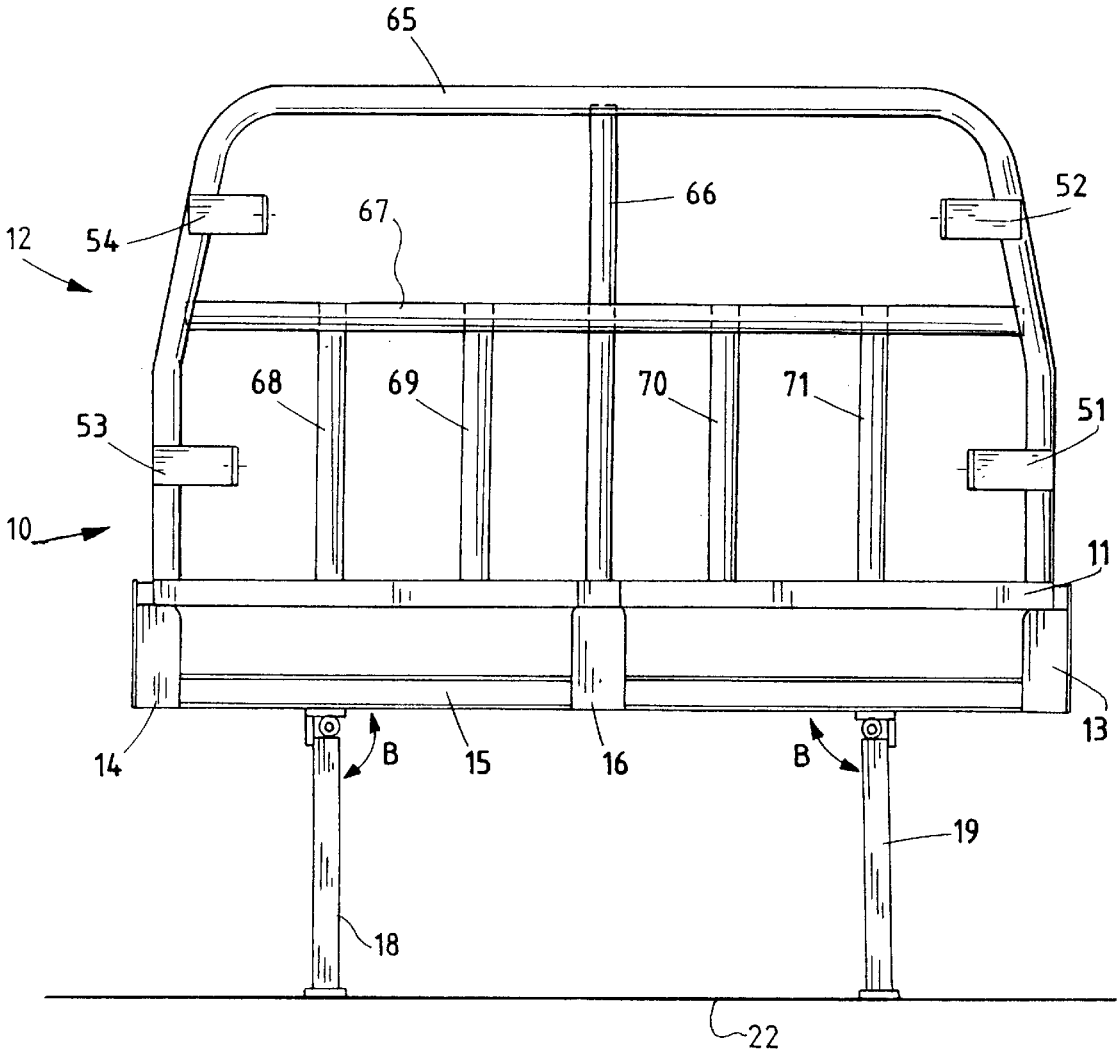
FIG. 4 is a front elevational view illustrating the flip seating portion in a substantially horizontal position and the support legs in a substantially vertical position.
Figure 5:
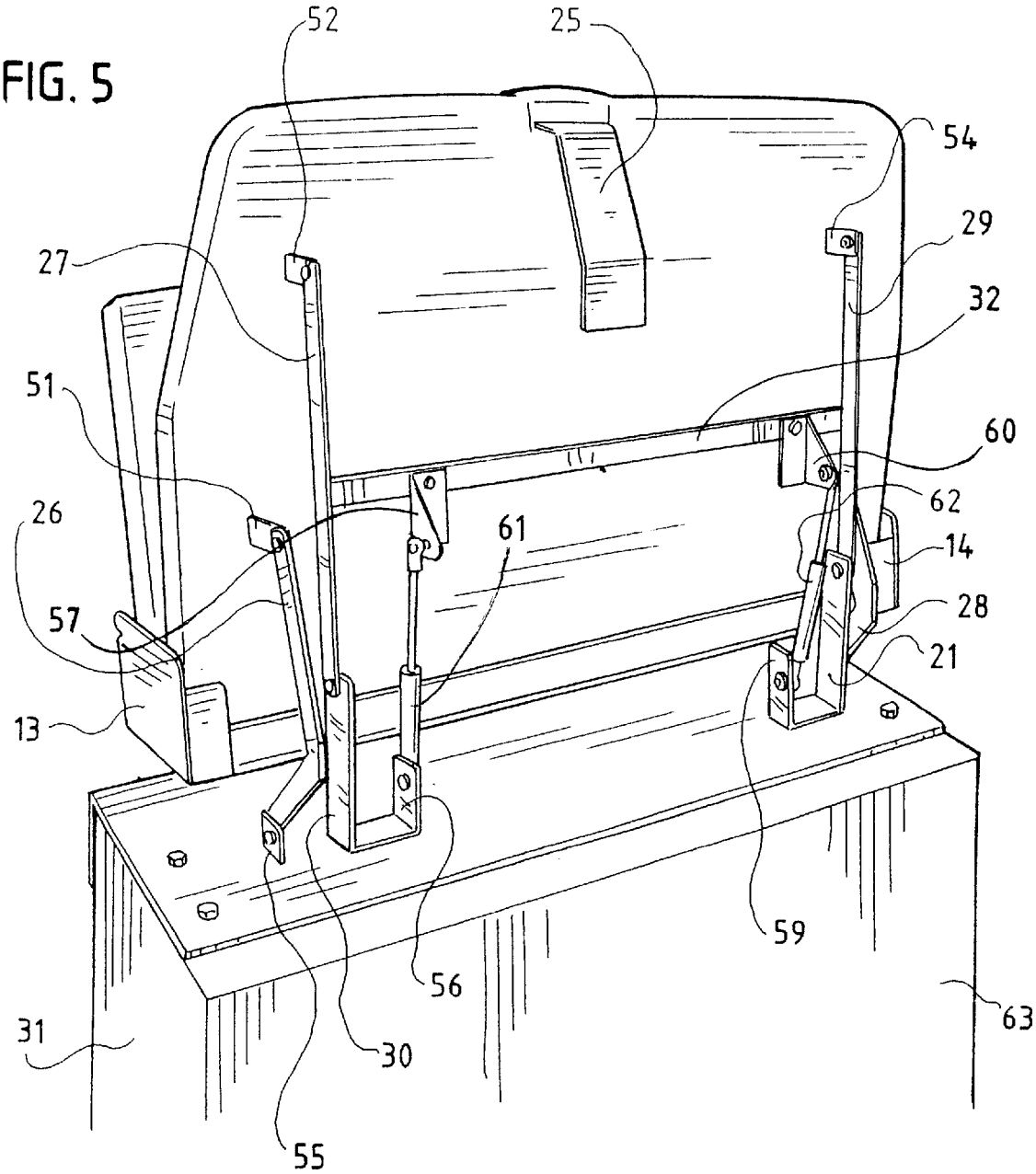
FIG. 5 is a pictorial view of the stowable swing away flip seat illustrating the linkage system while the stowable swing away flip seat is stowed.

Referring to FIGS. 1, 2, and 3, the stowable swing away flip seat 10 is shown. The stowable swing away flip seat 10 has a limitedly flip seating portion 11 and a fixed angled back support portion 12. Additionally, as seen in FIG. 4, the means for associating the flip seating portion 11 with the back support portion 12 includes seat plates 13, 14, and 15. The invention also includes two support legs 18 and 19, and a linkage system 20, as seen in FIGS. 1 and 5, which associates stowable swing way flip seat 10 with support member 31.

Figure 6:
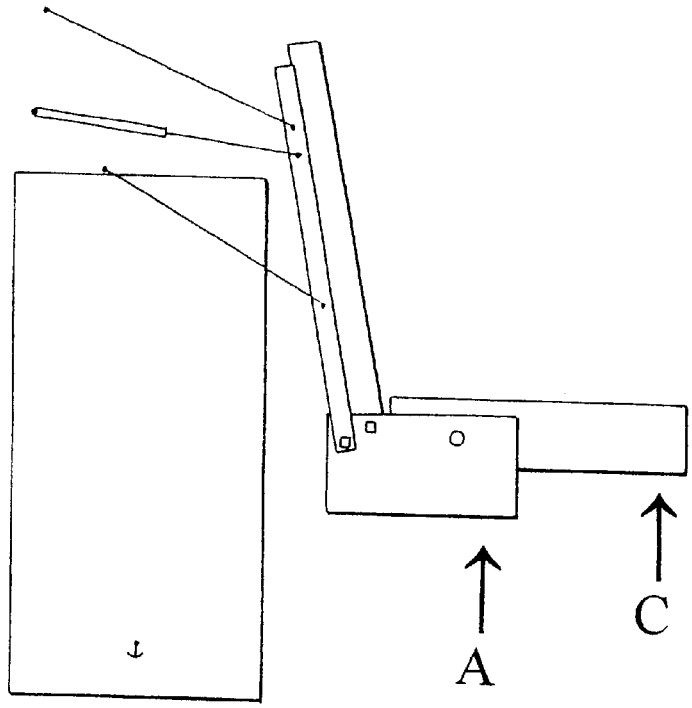
FIG. 6 is a motion study illustrating the flip seating portion in a substantially horizontal position and the stowable swing away flip seat in a deployed position.

Briefly, in operation, stowable swing way flip seat 10 is typically utilized in the deployed position as seen in FIGS. 1 and 4. Flip seating portion 11 is substantially horizontally and parallel to a horizontal floor base 22. Back support portion 12 is in a fixed and substantially vertical position, relative to floor base 22. Support legs 18 and 19 are in a substantially vertical position relative to floor base 22. Flip seating portion 11 is limited to moving hingedly from a substantially horizontal position to a substantially vertical position, as shown in FIG. 3. As illustrated in FIG. 4, support legs 18 and 19 are hingedly associated with the bottom of seat plate 15, with each having a range of motion indicated by arrows B. Support legs 18 and 19 are limited to moving hingedly, relative to floor base 22, from a substantially vertical position, as seen in FIG. 4, to a substantially horizontal position, as seen in FIG. 2. Linkage system 20 associates back support portion 12 with support member 31. Upon the exertion of lifting force A, as seen in FIG. 6, linking system 20 generates a predetermined path of motion, as seen in the motion study of FIGS. 6, 7 8, 9, and 10, to raise the stowable swing way flip seat 10 along the path from a deployed position to a stowed position above support member 31. The linkage system 20 ensures that stowable swing away flip seat 10 does not extend any further in the forward horizontal plane, relative to support member 31, than it did while in its original deployed position with the flip seating portion in a substantially horizontal position, as shown in FIG. 6.

Figure 7:
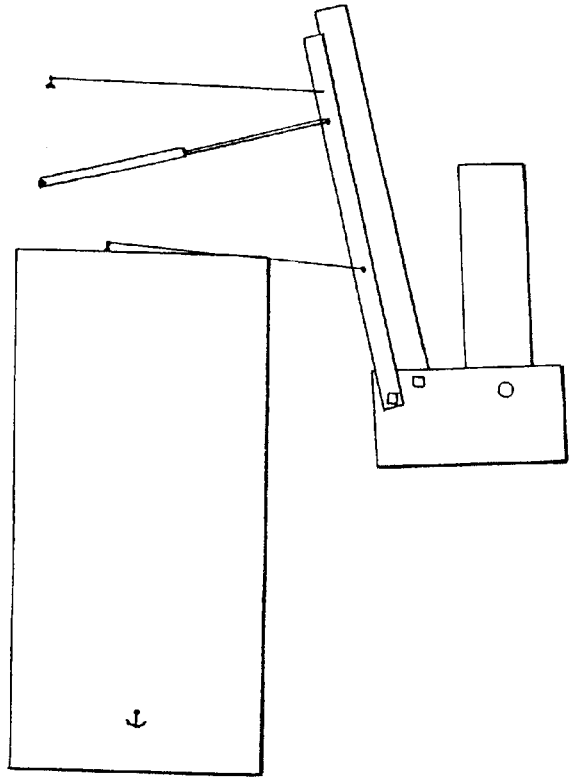
FIG. 7 is a motion study illustrating the flip seating portion in a substantially vertical position/and the stowable swing away flip seat in an intermediate position in between the deployed and stowed position.
Figure 8:
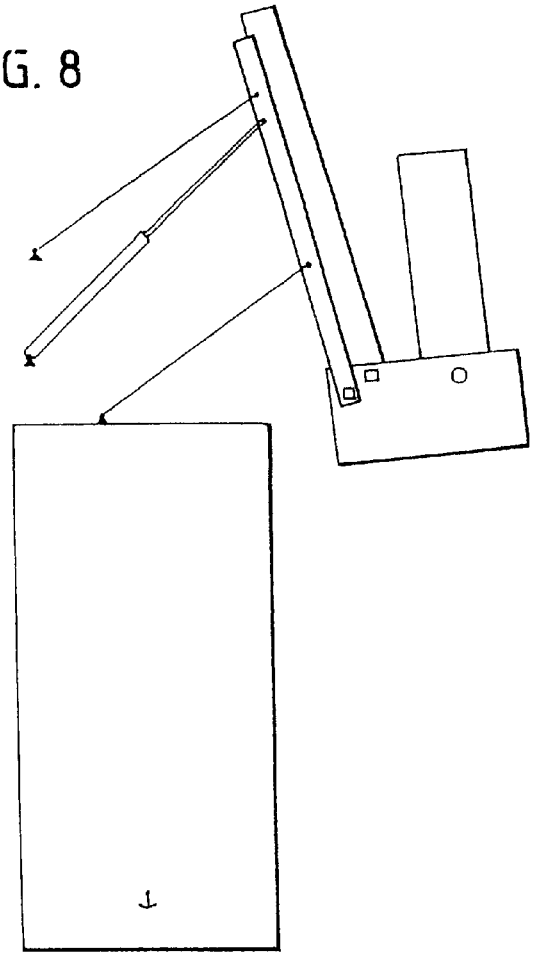
FIG. 8 is a motion study illustrating the flip seating portion in a substantially vertical position and the stowable swing away flip seat in an intermediate position in between the deployed and stowed position.
Figure 9:
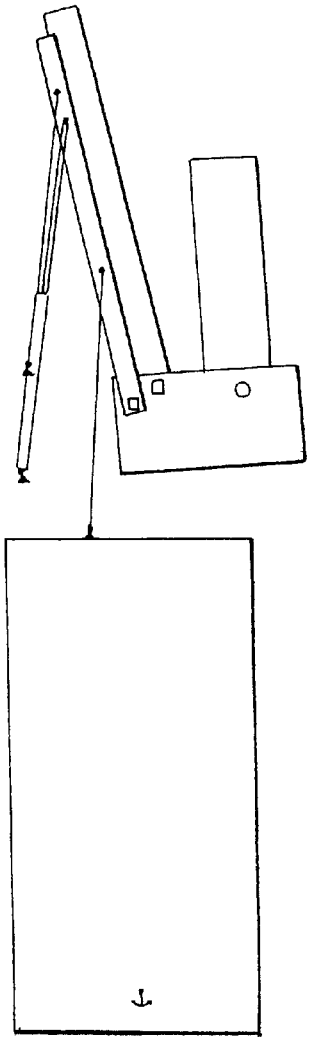
FIG. 9 is a motion study illustrating the flip seating portion in a substantially vertical position and the stowable swing away flip seat in an intermediate position in between the deployed and stowed position.
Figure 10:
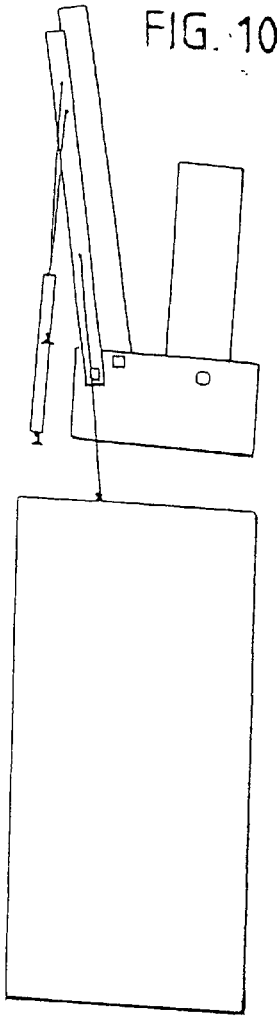
FIG. 10 is a motion study illustrating the flip seating portion in a substantially vertical position and the stowable swing away flip seat in a deployed position.
Figure 11:
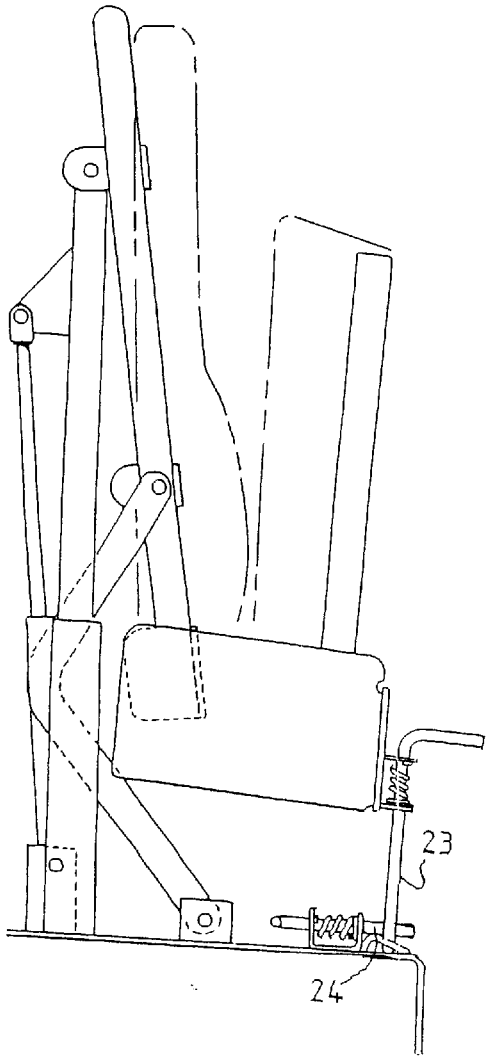
FIG. 11 is a side elevational view illustrating the locking mechanism locking the stowable swing away flip seat in a stowed position.

To provide a space for a wheelchair or other article, first support legs 18 and 19 are folded from a substantially vertical position, as seen in FIG. 4, to a substantially horizontal position, as illustrated in FIG. 2. Next, as seen in FIG. 6, an upward force C is applied to flip seating portion 11. As shown in FIG. 7, upward force C causes flip seating portion 11 to be flipped to a substantially vertical position relative to the floor base 22 that is shown in FIG. 3. Finally, upward force A is applied to the stowable swing way flip seat 10, as shown in FIG. 6. As illustrated in the motion study of FIGS. 6, 7, 8, 9, and 10, upward force A causes the linkage system 20 to raise the stowable swing away flip seat 10 from a deployed position to a stowed position above support member 31. Throughout the stowage operation, stowable swing away flip seat 10 does not extend further in the forward horizontal plane, relative to support member 31, than it does while deployed with flip seating portion in a substantially horizontal position. As seen in FIG. 3, once stowable swing away flip seat 10 reaches the stowed position, deflector plate 25 will be located proximate to wall 63. Upon further force in the stowed direction, deflector plate 25 will contact the wall 63 and prevent further movement. The stowable swing away flip seat 10 may be locked into position by the locking pins 23 and 24, as seen in FIG. 11. The stowable swing away flip seat 10 may be transported from a stowed to a deployed position by reversing the aforementioned steps and reversing upward force A to a downward force.

Figure 12:
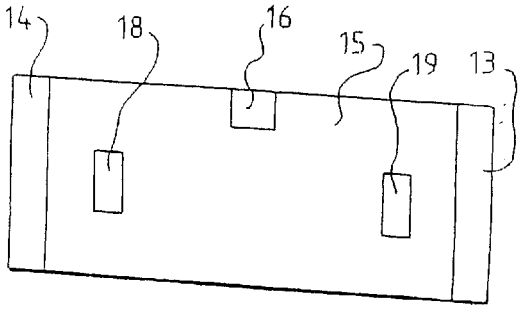
FIG. 12 is a bottom view illustrating the seating plates and the support legs in a substantially vertical position.

As illustrated in FIG. 4, a means for associating flip seating portion 11 with back support portion 12 comprises seat plate 13, 14, and 15 that are preferably made from steel. Seat plates 13 and 14 are mirror images. The configuration of seat plate 13 is collectively shown in FIGS. 1, 4, 5, and 12. Seat plates 13 and 14 are used to fix seat plate 15 in a substantially horizontal position, as illustrated in FIG. 4. Additionally, seat plate 16, which is used to support flip seating portion 11 while in a substantially horizontal position, is an L shaped structure preferably made from steel that is fixedly attached to seat plate 15, as shown in FIGS. 4 and 12. Seat plates 13, 14, 15, and 16 may be fabricated as one solid piece or may comprise individual plates collectively fixedly attached. The seat plates may be secured by welding them together or by using fasteners such as nuts and bolts.

As illustrated in FIGS. 1 and 4, support legs 18 and 19, preferably made from steel, are used as a means of supporting stowable swing way flip seat 10 while deployed. Support legs 18 and 19 are mirror images. In FIG. 4, the support legs 18 and 19 are shown hingedly associated with the bottom of seat plate 15. Support legs 18 and 19 are confined to a range of motion indicated by arrows B.

As shown in FIG. 1, flip seating portion 11 is generally rectangular and preferably made from steel. Flip seating portion 11 has a substantially horizontal position, as shown in FIG. 6, and a substantially vertical position, as shown in FIG. 7. Flip seating portion has limited rotation about a rotational axis. The rotational axis passes through mounting pivot 41 and an identical mirror image mounting pivot (not shown) that is associated with seat plate 14 in the same way as mounting pivot 41 is with seat plate 13 in FIG. 3. Furthermore, stopping device 43 is associated with one side of flip seating portion 1 1 and the mirror image stopping device is associated with the opposite side of flip seating portion in identical fashion. When flip seating portion 11 reaches a substantially vertical position relative to floor base 22, stopping device 41 contacts seat plate 13. While not shown, at the same time the other stopping device contacts seat plate 14 in identical fashion. The dual contact prevents further rotation. As illustrated in FIG. 4, when flip seating portion 11 reaches a substantially horizontal position, the bottom of flip seating portion 11 rests upon seat plates 13, 14, and 16, which thereby prevents further rotation.

Back support portion 12 comprises bars 65, 66, 67, 68, 69, 70, and 71, preferably made from steel, which are fixedly associated as illustrated in FIG. 4. The means of associating back support portion 12 with seat plates 13 and 14 comprises brackets 49 and 50 and mounting bolts 45, 46, 47, and 48. Brackets 49 and 50 are fixed near the bottom and at opposite sides of support bar 65, as illustrated in FIG. 1. Mounting bolts 45 and 46 pass from plate 13 through bracket 49, and mounting bolts 47 and 48 pass from plate 14 and then through bracket 50. The bolts may be secured by any number of means, including nuts, or welding, or the like. Bolts 45, 46, 47, and 48 are positioned so that back support portion 12 is fixed at a substantially vertical position relative to a horizontal flat floor base 22.

Referring to FIGS. 1 and 5, back support portion 12 is hingedly associated with support member 31 via a four bar linkage system 20. Linkage system 20, preferably made from steel, comprises biasing brackets 57 and 60; linkage bars 21, 26, 27, 28, 30, and 32; and biasing cylinders 61 and 62. The means of associating linkage system 20 with back support 12 comprises back support brackets 51, 52, 53, and 54, which are positioned as illustrated in FIG. 1. The means of associating linkage system 20 with support member 31 comprises support member brackets 55, 56, 58, and 59, which are positioned as illustrated in FIG. 1. As seen in FIGS. 1 and 5, one end of linkage arm 26 is hingedly associated with back support bracket 51 and the other end is hingedly associated with support member bracket 55. One end of linkage arm 27 is hingedly associated with back support bracket 52 and the other end is hingedly associated with linkage arm 30. The other end of linkage arm 30 is fixedly attached to support member bracket 56. Thus, linkage arm 30 is fixed in a substantially vertical position relative to the horizontal top of support member 31. One end of linkage arm 28 is hingedly associated with back support bracket 53 and the other end is hingedly associated with support member bracket 58. One end of linkage arm 29 is hingedly associated with back support bracket 54 and the other end is hingedly associated with linkage arm 31. The other end of linkage arm 31 is fixedly attached to support member bracket 59. Thus, linkage arm 31 is fixed in a substantially vertical position. As illustrated in FIG. 5, linkage arm 32 has two ends. One end of linkage arm 32 is fixedly associated with linkage arm 27 and the other end is fixedly associated with linkage arm 29. Linkage arm 32 is oriented such that it is perpendicular to linkage arms 27 and 29 and spans the distance between linkage arms 27 and 29. Biasing brackets 57 and 60 are fixedly associated at opposite sides of linkage arm 32.

Linkage system 20 utilizes biasing cylinders 61 and 62 as a means of biasing. One end of biasing cylinder 61 is hingedly associated with biasing bracket 57 and the other end is hingedly associated with support member bracket 56. One end of biasing cylinder 62 is hingedly associated with biasing bracket 60 and the other end is hingedly associated with support member bracket 59. When performing the stowage operation, linkage system 20 works as illustrated in the motion study of FIGS. 6, 7, 8, 9, and 10. The stowable swing away flip seat 10 is transported above support member 31. Deflector plate 25 is fixedly associated with the top center portion of bar 65 and, as illustrated in FIG. 3, is proximate to wall 63 when the stowable swing away flip seat 10 is in the stowed position.

As illustrated in FIG. 11 locking pins 23 and 24, preferably made from steel, are used to lock stowable swing away flip seat 10 in its stowed position. Locking pin 23 is fixedly attached to a front lip of seat plate 14. Locking pin 24 is fixedly attached to support member 31. Locking pins 23 and 24 are positioned so that locking pin 24 will pass through a hole in locking pin 23 and prevent deployment of stowable swing away flip seat 10. Locking pin 24 can disengage from locking pin 23 by removing it from the hole in locking pin 23. Locking pin 23 can then be lifted, which will permit deployment of stowable swing away flip seat 10.

It may thus be seen that the objects of the present inventions set forth herein as well as those made apparent from the foregoing descriptions, are officially obtained. While preferred embodiments of the invention have been set forth for purposes of disclosure, modification of disclosed embodiments of the invention as well as other embodiments thereof may occur to those skilled in the art. Accordingly, the appended claims are intended to cover all embodiments that do not depart from the spirit and scope of the invention.

What we claim is:

1. In combination:

a stowable swing away flip seat having a flip seating portion hingedly associated with a back support portion, said flip seating portion having a substantially horizontal position that provides seating for an occupant, said flip seating portion having a substantially vertical position, in which said stowable swing away flip seat is compacted by having said flip seating portion folded proximate to said back support portion and substantially parallel; and a linkage system hingedly associating said back support portion with a support member, said linkage system, upon an exertion of a lifting force, generating a predetermined path of motion that swings said stowable swing away flip seat from a deployed position, adjacent to a side of said support member, to a stowed position above said support member, said linkage system supporting said stowable swing away flip seat while in said deployed and said stowed positions, said deployed position having said flip seating portion in said substantially horizontal position, and providing seating for an occupant, said stowed position having said flip seating portion in a substantially vertical position and providing space for positioning a wheelchair or other article in the space formerly occupied by said stowable swing away flip seat while deployed.

2. The combination as defined in claim 1, wherein said linkage system comprises a four bar linkage system.

3. The combination as defined in claim 1, wherein said linkage system further comprises a biasing means, said biasing means being used to provide a consistent distribution of weight during a stowage operation and to insure that a stowage operator does not have to perform any awkward maneuvers.

4. The combination as defined in claim 1, further comprising a locking means being used to lock said stowable swing away flip seat in a stowed position.

5. The combination as defined in claim 1, wherein said linkage system, upon the exertion of a lifting force, generates a path of motion that transports said stowable swing away flip seat during a stowage operation so that it does not protrude further in the forward horizontal plane, relative to said support member, then in its original deployed position with said flip seating portion in its substantially horizontal position.

6. The combination as defined in claim 1, wherein a deflecting plate is fixedly attached to said stowable swing away flip seat, said deflecting plate being proximate to a fixed structure when in a stowed position, said deflecting plate limiting further rotation once a stowed position is reached.

7. The combination as defined in claim 1, wherein a means of hingedly associating said back support portion with said flip seating portion comprises a seat plate portion, said seat plate portion fixedly attached to said back support portion and hingedly associated with said flip seating portion.

8. The combination as defined in claim 1, further comprising a support means associated with said swing away flip seat, said support means extending from said stowable swing away flip seat to a floor base, thereby supporting said stowable swing away flip seat.

9. In combination:

a stowable swing away flip seat having a flip seating portion hingedly associated with a back support portion, said flip seating portion having a substantially horizontal position that provides seating for an occupant, said flip seating portion having a substantially vertical position, in which said stowable swing away flip seat is compacted by having said flip seating portion folded proximate to said back support portion and substantially parallel;

a plurality of seating plates for hingedly associating said flip seating portion with said back support portion, said flip seating portion having a hingedly associated end being pivotably mounted to first and second seat plates by first and second mounting pivots, said flip seating portion capable of limited rotation about an axis passing through said first and second mounting pivots, whereby said flip seating portion may rotate from said substantially horizontal position to said substantially vertical position said first seat plate being fixedly attached to a first side of said back support portion, said second seat plate being fixedly attached to a second side of said back support portion;

a linkage system hingedly associating said back support portion with a support member, said linkage system, upon an exertion of a lifting force, generating a predetermined path of motion that swings said stowable swing away flip seat along the path of motion from a deployed position, adjacent to a side of said support member, to a stowed position above said support member, said linkage system supporting said stowable swing away flip seat while in said deployed and said stowed positions, said deployed position having said flip seating portion in said substantially horizontal position, and providing seating for an occupant, said stowed position having said flip seating portion in a substantially vertical position and providing space for positioning a wheelchair or other article in the space formerly occupied by said stowable swing away flip seat while deployed, said linkage system generating a path of motion that confines the route traveled by said seat during a stowage operation so that said seat does not protrude further in the forward horizontal plane, relative to said support member, than it does while in its original deployed position with said flip seating portion in a substantially horizontal position;

a top side of said back support portion being fixedly attached to a deflector plate, whereby upon completion of the stowage operation said deflector plate is positioned to limit further swinging motion in a stowed direction by making contact with any obstruction;

said linkage system being a four bar linkage system comprising first and second upper bars, first and second lower bars, a linking arm, and first and second biasing cylinders;

said first and second lower bars each being an angular arm having a first and second end, said first end of said first lower bar being hingedly associated with said back support portion at a point being proximate to said first side of said back support portion and being proximate to a bottom side of said back support portion, said second end of said first lower bar being hingedly associated with said support member; said first end of said second lower bar being hingedly associated with said back support portion at a point being proximate to said second side of said back support portion and being proximate to said bottom side of said back support portion, said second end of said second lower bar being hingedly associated with said support member;

said first and second upper bars each having one fixed arm and one rotatable arm, said fixed arms and rotatable arms each having first and second ends;

said first end of said fixed arm of said first upper bar being fixedly associated with said support member, whereby said fixed arm is fixed in a substantially vertical position relative to said support member, said second end of said fixed arm of said first upper bar being hingedly associated with said first end of said rotatable arm of said first upper bar, said second end of said rotatable arm being hingedly associated with said back support portion at a point proximate to said first side of said back support portion and to said top side of said back support portion;

said first end of said fixed arm of said second upper bar being fixedly associated with said support member, whereby said fixed arm is fixed in a substantially vertical position relative to said support member, the said second end of said fixed arm of said second upper bar being hingedly associated with said first end of said rotatable arm of said second upper bar, said second end of said rotatable arm of said second upper bar being hingedly associated with said back support portion at a point proximate to said second side of said back support portion and to said top of said back support portion;

said linking arm being elongated and having first and second sides, said first side being fixedly attached to said rotatable arm of said first upper bar, said second side of said linkage bar being fixedly attached to said rotatable arm of said second upper bar, whereby said linking arm spans the distance between said first and second upper bars;

said first biasing cylinder having first and second sides, said first side being hingedly associated with said fixed arm of said first upper bar and said second side being hingedly associated with said linkage bar proximate to said first side of said linking arm; and said second biasing cylinder having first and second sides, said first side being hingedly associated with said fixed arm of said second upper bar and said second side being hingedly associated with said linkage bar proximate to said second side of said linking arm.

10. The combination as defined in claim 9, further comprising a locking means used to lock said stowable swing away flip seat in a stowed position.

11. The combination as defined in claim 9, further comprising a support means associated with said swing away flip seat, said support means extending from said stowable swing away flip seat to a floor base, thereby supporting said stowable swing away flip seat.

12. The combination as defined in claim 10, further comprising a support means associated with said swing away flip seat, said support means extending from said stowable swing away flip seat to a floor base, thereby supporting said stowable swing away flip seat.

13. In combination:

a stowable swing away seat that is capable of providing seating for an occupant; and a linkage system hingedly associating said stowable swing away seat with a support member, said linkage system, upon an exertion of a lifting force, generating a predetermined path of motion that swings said stowable swing away seat along the path of motion from a deployed position, adjacent to a side of said support member, to a stowed position above said support member, said linkage system supporting said stowable swing away seat while in said deployed and said stowed positions, said deployed position providing seating for an occupant, said stowed position providing space for positioning a wheelchair or other article in the space formerly occupied by said stowable swing away seat while deployed.

14. The combination as defined in claim 13, wherein said linkage system comprises a four bar linkage system.

15. The combination as defined in claim 13, wherein said stowable swing away seat comprises a flip seating portion and a back support portion being hingedly associated, said flip seating portion being capable of limited rotation, from a substantially horizontal position to a substantially vertical position, relative to said back support portion in a substantially vertical position.

16. The combination as defined in claim 13, wherein said linkage system generates a path of motion that confines the route traveled by said seat during a stowage operation so that said seat does not protrude further in the forward horizontal plane, relative to said support member, then it does while in its original deployed position.

* * * * *